US006789600B2

(12) United States Patent
O'Neill Kuchinsky

(10) Patent No.: US 6,789,600 B2
(45) Date of Patent: Sep. 14, 2004

(54) MULTIFUNCTIONAL WINDOW COVERING SYSTEM AND CORRESPONDING METHODS FOR SECURING FABRIC MATERIAL WITH RESPECT TO A WINDOW STRUCTURE

(76) Inventor: Caroline O'Neill Kuchinsky, 18929 Fountain Hills Dr., Germantown, MD (US) 20874

( * ) Notice: Subject to any disclaimer, the term of this patent is extended or adjusted under 35 U.S.C. 154(b) by 0 days.

(21) Appl. No.: 10/372,162

(22) Filed: Feb. 25, 2003

(65) Prior Publication Data

US 2003/0178161 A1 Sep. 25, 2003

Related U.S. Application Data

(60) Provisional application No. 60/359,714, filed on Feb. 27, 2002.

(51) Int. Cl.[7] ..... A47H 13/14
(52) U.S. Cl. ..... 160/348; 160/349.2
(58) Field of Search ..... 160/349.2, 349.1, 160/348, 405; 24/17 R, 17 B, 716, 573.09, 16 R

(56) References Cited

U.S. PATENT DOCUMENTS

| | | | | |
|---|---|---|---|---|
| 1,567,196 A | | 12/1925 | Roy | |
| 2,053,332 A | | 9/1936 | Gossner | |
| 2,107,421 A | * | 2/1938 | Lennox | 160/349.1 |
| 2,293,883 A | * | 8/1942 | Bossert | 160/349.2 |
| 2,355,705 A | * | 8/1944 | Herman | 24/716 |
| 2,588,256 A | | 3/1952 | Lepow | |
| 3,099,271 A | * | 7/1963 | Dubelier | 132/273 |
| 3,159,206 A | | 12/1964 | Susnow | |
| 3,433,281 A | | 3/1969 | Lukashok | |
| 3,751,769 A | * | 8/1973 | Reiner | 24/300 |
| 4,569,108 A | * | 2/1986 | Schwab | 24/17 R |
| 5,146,972 A | | 9/1992 | Tacchella | |
| 5,199,135 A | * | 4/1993 | Gold | 24/16 R |
| 5,238,044 A | | 8/1993 | Gilley et al. | |
| 5,240,059 A | | 8/1993 | White | |
| 5,392,839 A | | 2/1995 | Gilley et al. | |
| 5,738,159 A | | 4/1998 | O'Brien | |
| 5,894,876 A | | 4/1999 | O'Brien | |
| 5,911,265 A | | 6/1999 | Dreher | |
| 5,927,371 A | * | 7/1999 | Schofield et al. | 160/348 |
| 5,996,675 A | * | 12/1999 | Sturgis | 160/349.2 |
| 6,192,962 B1 | | 2/2001 | Glover | |
| 6,389,659 B1 | * | 5/2002 | Jacobs | 24/573.09 |

* cited by examiner

*Primary Examiner*—David Purol
(74) *Attorney, Agent, or Firm*—Edell, Shapiro & Finnan, LLC

(57) ABSTRACT

A multifunctional window covering system for securing various lengths, sizes and types of curtains and/or drapery or other fabric material in a wide variety of different window treatment styles and configurations with respect to a window structure includes at least one securing device with a securing section and a loop section. The securing device is configured to wrap around a fabric material and/or support structure disposed proximate the window, with the securing section capable of being inserted through the loop section to facilitate engagement of the securing section with the loop section so as to hold and maintain the fabric material in a desired configuration with respect to the window structure.

11 Claims, 8 Drawing Sheets

MULTIFUNCTIONAL WINDOW COVERING SYSTEM AND CORRESPONDING METHODS FOR SECURING FABRIC MATERIAL WITH RESPECT TO A WINDOW STRUCTURE

CROSS REFERENCE TO RELATED APPLICATION

This application claims priority from U.S. Provisional Patent Application Ser. No. 60/359,714, entitled "Multifunctional Window Covering System" and filed Feb. 27, 2002. The disclosure of the above-mentioned provisional application is incorporated herein by reference in its entirety.

BACKGROUND OF THE INVENTION

1. Technical Field

The present invention relates to a system for securing fabric material with respect to a window structure in a variety of window treatment styles and configurations.

2. Description of the Related Art

Most drapery hardware and related devices presently designed are known to suspend, manipulate, arrange and position fabric for curtains, drapes, etc. in a specific arrangement or style. Certain drapery hardware/devices that provide alternative window treatment arrangements are limited to a few variations (e.g., providing shorter or longer lengths, combining the same arrangement a number of times to create a larger version of the same arrangement, providing the same window covering style in different colors and/or textures, etc.).

Other devices must be suspended or attached to a main support bar at all times in order to form different styles. Little variation is seen as the drapery fabric often remains in the same general vertical position.

Still other devices are required to be installed into a main support system such as a window or wall in order for the device to function properly, and, thus, these devices are limited to use with the same hanging support device.

Accordingly, it is desirable to provide a window covering and securing system that is versatile and facilitates a variety of styles and arrangements for fabric secured about one or more windows.

SUMMARY OF THE INVENTION

It is an object of the present invention to provide a multifunctional device that enables draperies and window coverings to be manipulated into numerous (e.g., greater than twenty) configurations of varying styles and arrangements.

It is another object of the present invention to provide a device that can be utilized without permanent installation of the device or a hanging support bar or hardware into a main support system.

It is a further object of the present invention to provide a device that is inexpensive, easy to use, and requiring very little time and effort to achieve a selected window treatment style for a particular fabric material.

The aforesaid objects are achieved individually and/or in combination, and it is not intended that the present invention be construed as requiring two or more of the objects to be combined unless expressly required by the claims attached hereto.

A multifunctional window covering system designed to create numerous window covering configurations in a variety of styles and sizes includes a securing device to fasten fabric material in a selected manner. The securing device includes an elongated elastic loop section connected to a securing section disposed at a longitudinal end of the securing device. The loop section wraps around one or more selected portions of fabric material, and the securing section is inserted through the loop section to engage the securing and loop sections thus securing the fabric material in the selected configuration. The system may further include two or more securing devices coupled together to form a combined securing device configured for use with fabric materials of varying dimensions, weight, thickness, etc.

The system is configured for use with multiple lined or unlined flexible fabric panels in varying lengths and widths. The panels can be interchangeable, suspend from a horizontally suspended bar or other suitable support structure and are joined and secured into different configurations by the securing device. The device and/or panels may then be wrapped around the support bar or left to hang unsuspended at the securing location between the device and the panels.

The above and still further objects, features and advantages of the present invention will become apparent upon consideration of the following detailed description of specific embodiments thereof, particularly when taken in conjunction with the accompanying drawings wherein like reference numerals in the various figures are utilized to designate like components.

DESCRIPTION OF THE PREFERRED EMBODIMENTS

Detailed embodiments of the present invention are disclosed below, however, it is to be understood that the disclosed embodiments are only examples of the invention that may be embodied in various forms other than those embodiments shown. Therefore, the structural and functional elements of the embodiments made known are merely representative in form and are not to be interpreted as limiting, but as a basis for which the various window covering configurations can be achieved.

Figure 1:
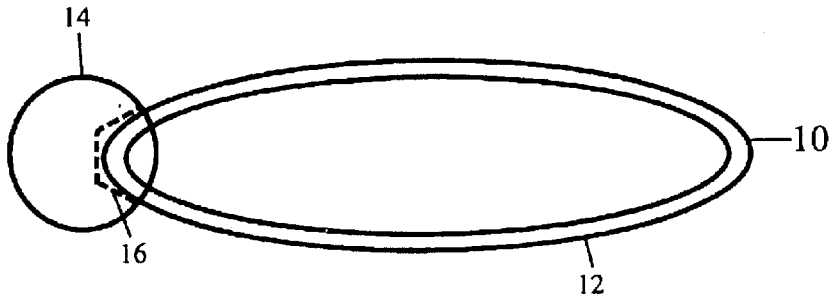
FIG. 1 depicts a securing device including a loop section and a securing section to facilitate fastening of the securing device with a fabric material in accordance with the present invention.

A window covering system includes a securing device to facilitate fastening of fabric material in a variety of different configurations. Referring to FIG. 1, securing device 10 includes an elongated and closed loop section 12 formed from a flexible piece of material (e.g., cord), with one longitudinal end of the loop section being connected to a securing section 14. Specifically, the longitudinal end of the loop section is secured in an opening 16 of the securing section (e.g., via an adhesive bond). Alternatively, the loop section may be open at one longitudinal end to form two terminal end members that may be secured within the securing section. The loop section is preferably constructed of an elastic material to facilitate resilient stretching of the device during use.

Securing section 14 includes a spherical geometric configuration to serve as a knob type fastener for the loop section when the loop section is wrapped around a fabric material, support bar or other structure in a manner described below. Alternatively, the securing section may have any other suitable geometric configuration (e.g., square, triangular, multifaceted, etc.) that is also capable of fastening the loop section when the loop section is wrapped around any structure.

Figure 2:
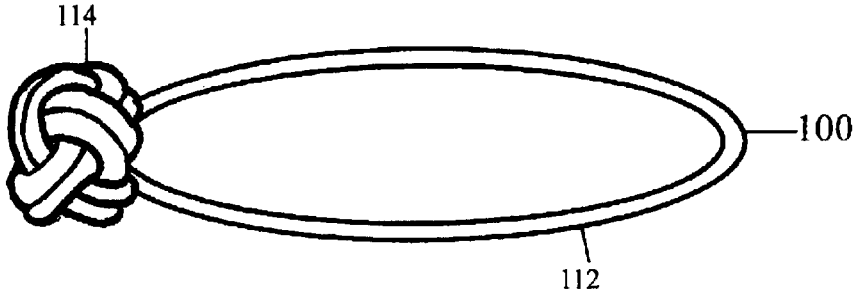
FIGS. 2–4 depict alternative embodiments for the securing device of the present invention.
Figure 3:
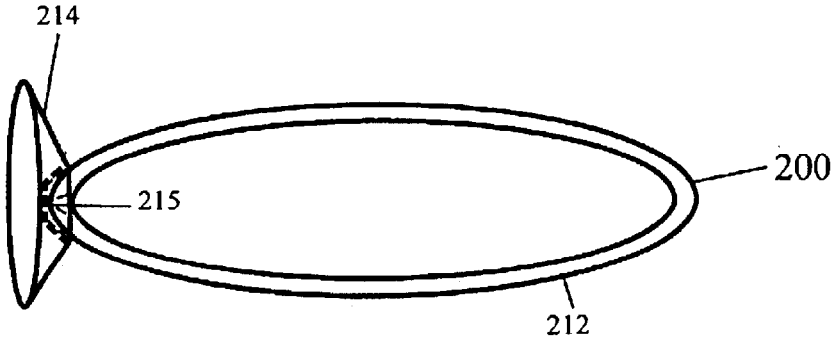
Figure 4:
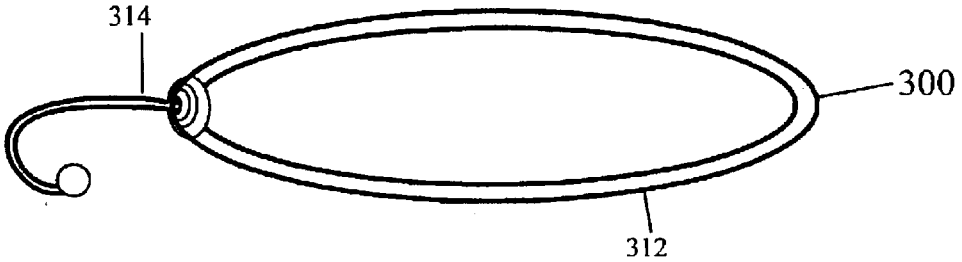

Other exemplary geometric configurations that are useful for the securing device are illustrated in FIGS. 2–4. In particular, FIG. 2 depicts a securing device 100 with a knob fastener section 114 constructed by forming a knot with one of the longitudinal ends of loop section 112. In FIG. 3, a securing device 200 includes a securing section 214 having a truncated cone or frustoconical geometry, with the smaller surface area longitudinal end of the securing section being attached via connection 215 to loop section 212. FIG. 4 depicts a securing device 300 having a securing section 314 consisting of a hook extending from a longitudinal end of loop section 312. It is to be understood that each of the securing devices depicted in FIGS. 2–4 are capable of being utilized in a substantially similar manner as device 10.

Figure 5:
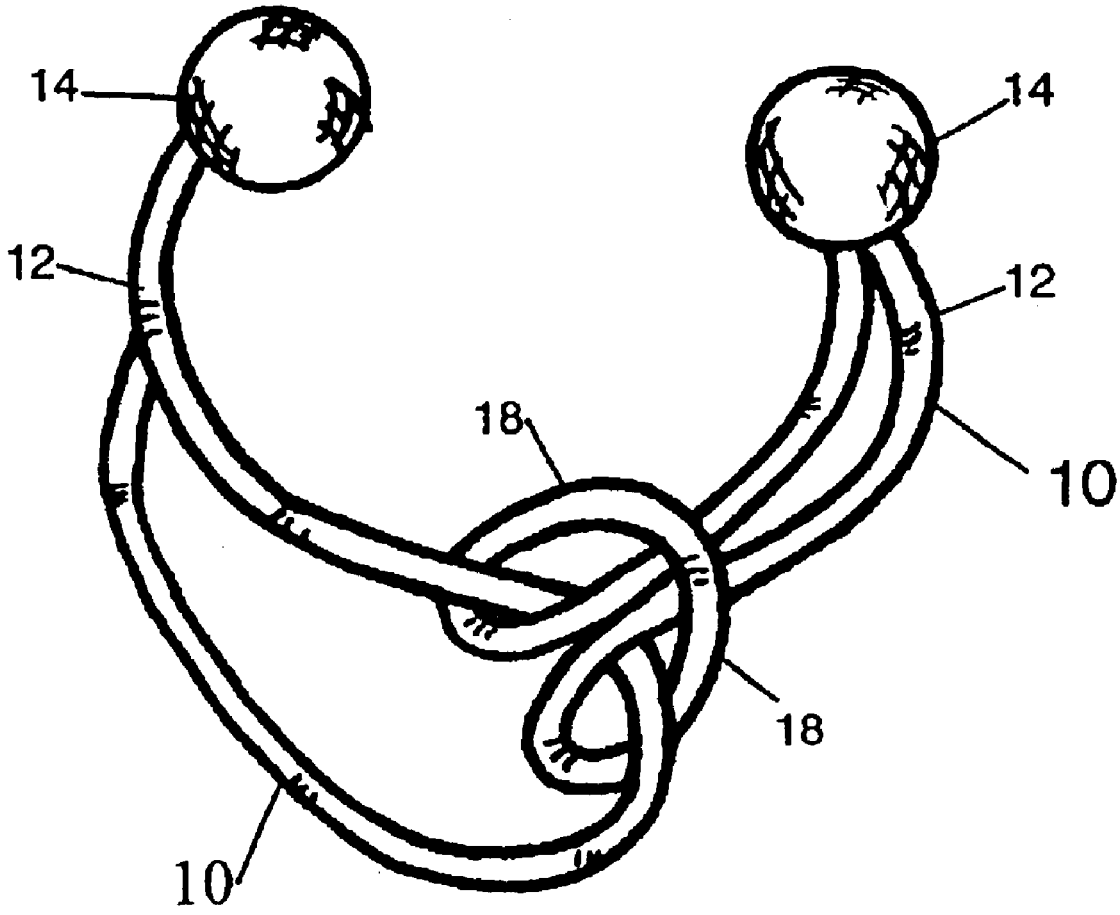
FIG. 5 depicts two securing devices of FIG. 1 coupled to form a combined securing device with added length for heavier or thicker panels.

In another embodiment, two or more securing devices may be coupled together to form a longer, combined securing device for use in particular situations such as those described below. Referring to FIG. 5, two devices 10 can be coupled to form a combined device 18 by inserting securing section 14 of the first device 10 through loop section 12 of the second device 10. The securing section of the first device is then inserted through loop section 12 of the first device and pulled to tighten the loop section of the first device around the loop section of the second device, thus securing the two devices together to form the combined device 18. As depicted in FIG. 5, both securing sections 14 of the devices 10 are disposed at opposing longitudinal ends of the combined device 18. However, the combined device may also be formed with one securing section being disposed at the location where the two securing devices are joined, thus yielding a combined device with the securing section of one securing device being disposed at one longitudinal end of the combined device and a loop section end of the other securing device being disposed at the other longitudinal end of the combined device. It is noted that two or more securing devices may be coupled together in any other suitable manner to form a combined device having any selected dimensions and geometric configurations.

Securing device 10 can be attached to one or more flexible fabric panels in a variety of different ways. In one embodiment, depicted in FIG. 6, support section 14 of device 10 is wrapped around a flexible fabric panel 22 at a selected location of the panel, is inserted through loop section 12 and pulled tight. One or more wrapping cycles of the securing section around the fabric panel may be required depending upon the thickness and weight of the flexible fabric panel and its tail portion 27. Once the securing section of the device is sufficiently wrapped around the fabric panel and inserted through the loop section, the securing section provides a catch or a stop to effectively inhibit or prevent the loop section from disengaging from the securing section without manual assistance.

Figure 6:
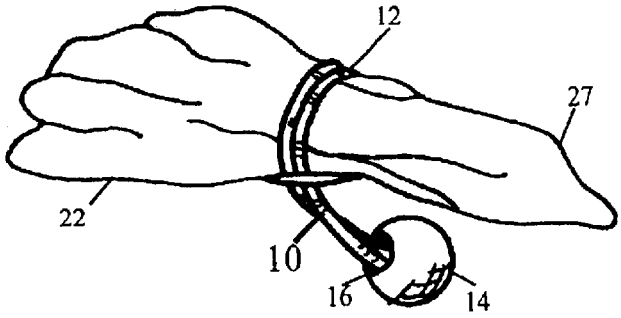
FIGS. 6–9 illustrate different methods for securing a fabric material to a support bar in accordance with the present invention utilizing the securing device of FIG. 5.
Figure 13:
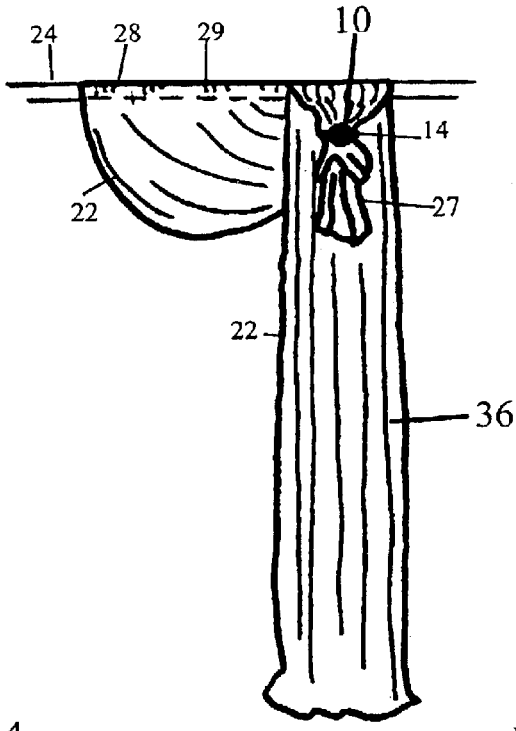
Figure 15:
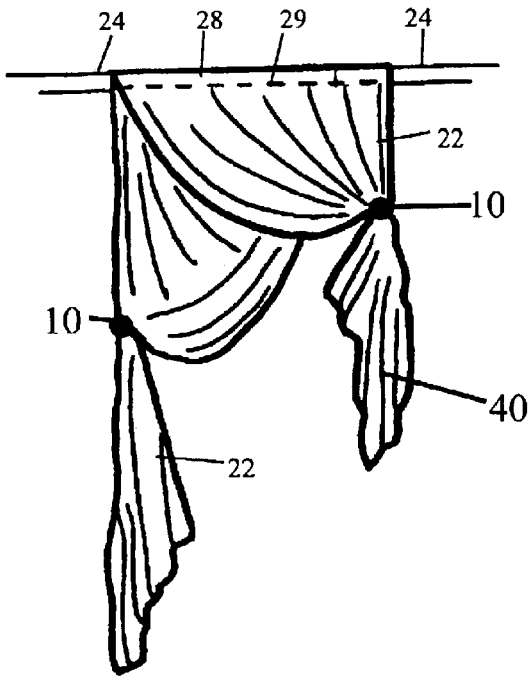
Figure 16:
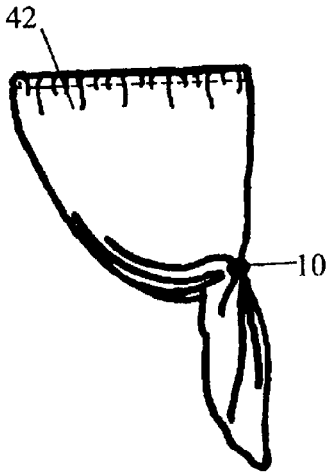
Figure 17:
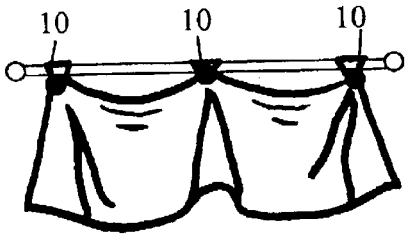
Figure 18:
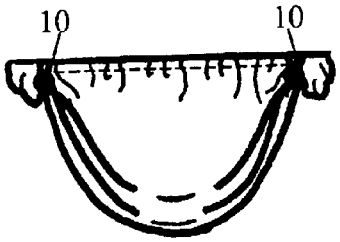
Figure 19:
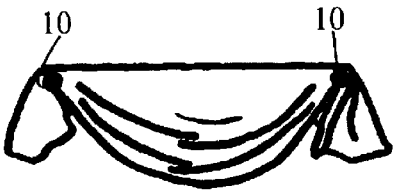
Figure 20:
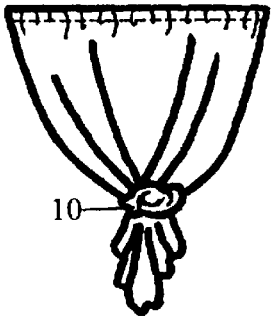
Figure 21:
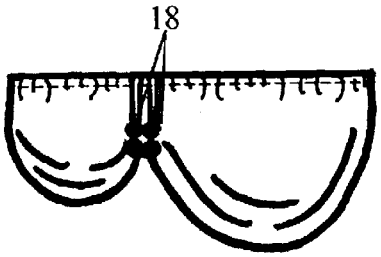
Figure 22:
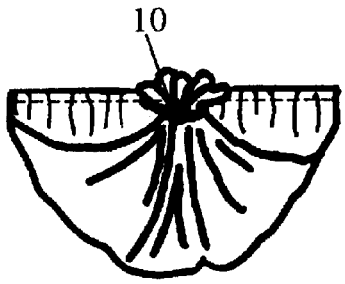
Figure 23:
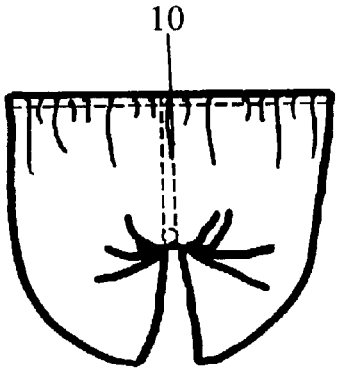
Figure 24:
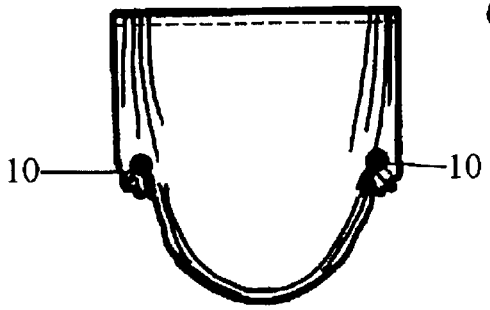
Figure 25:
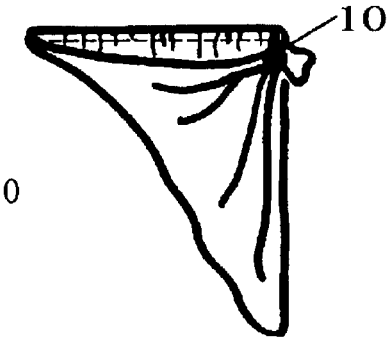
Figure 26:
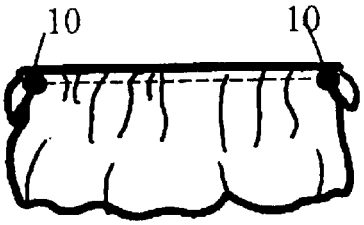
Figure 27:
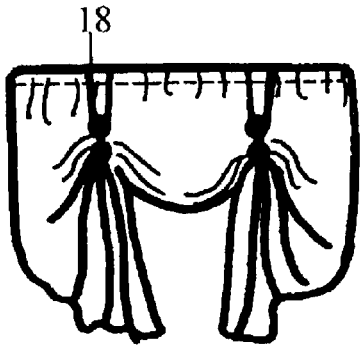
Figure 28:
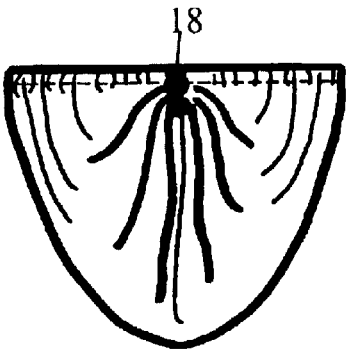
Figure 29:
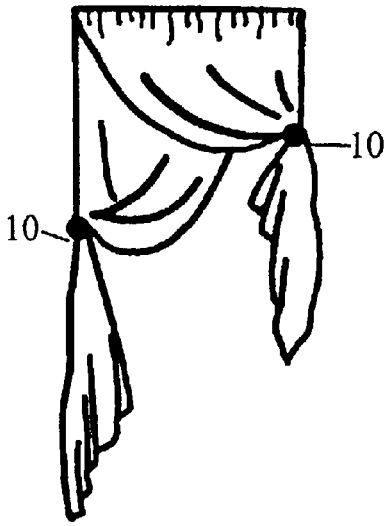
Figure 30:
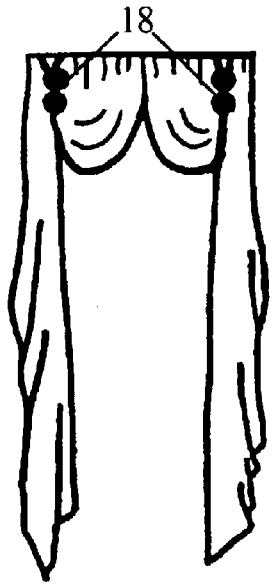

FIGS. 13 and 15 depict window treatment styles that utilize the wrapping configuration depicted in FIG. 6 to secure fabric panels 22 in selected configurations with respect to a horizontally oriented hanging support bar 24. In the window treatment configurations of FIGS. 13 and 15, device 10 is utilized for gathering and securing the flexible fabric panel 22 into particular arrangements 36 and 40. The fabric panels are supported on support bar 24 by feeding the support bar through a rod pocket 28, secured by stitches 29, formed at a top portion of the fabric panels.

Figure 7:
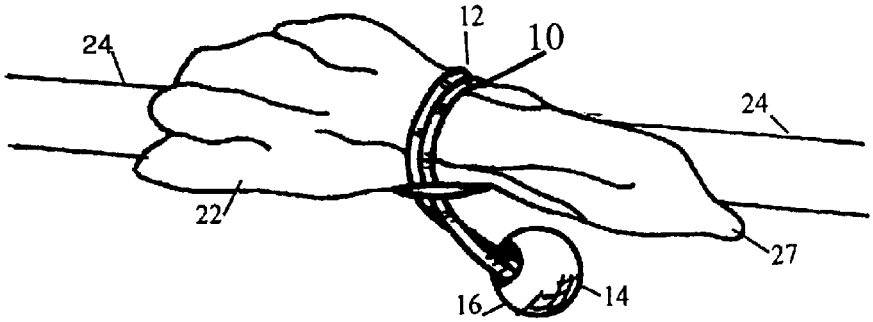

In another embodiment, depicted in FIG. 7, securing device 10 secures a flexible fabric panel 22 directly to a hanging support bar 24. The looped segment 12 of the securing device 10 is wrapped around the flexible fabric panel 22 and the support bar 24, in a substantially similar manner as the previous embodiment described above and depicted in FIG. 6, until a tight fit is obtained. In this embodiment, as in the previous embodiment, securing section 14 effectively inhibits or prevents disengagement of loop section 12 from the securing section, thus maintaining the hold of device 10 with respect to fabric panel 22 and support bar 24. The window treatment configuration of FIG. 12 utilizes the wrapping configurations of FIG. 7 to form an arrangement 34.

Figure 8:
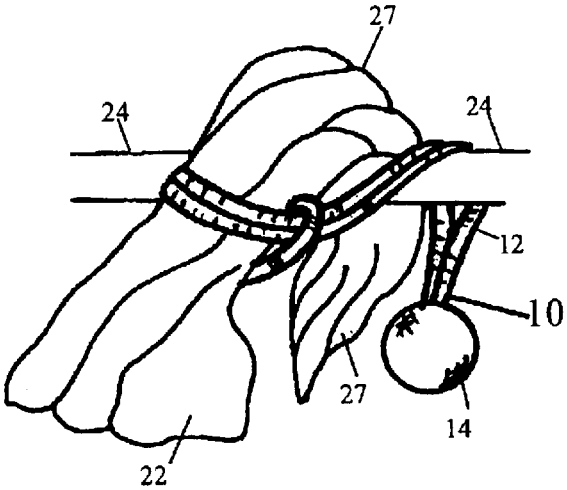
Figure 9:
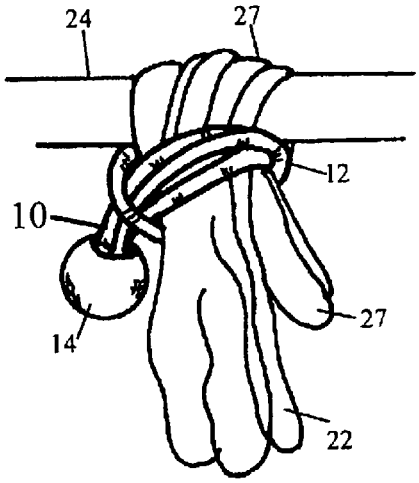
Figure 11:
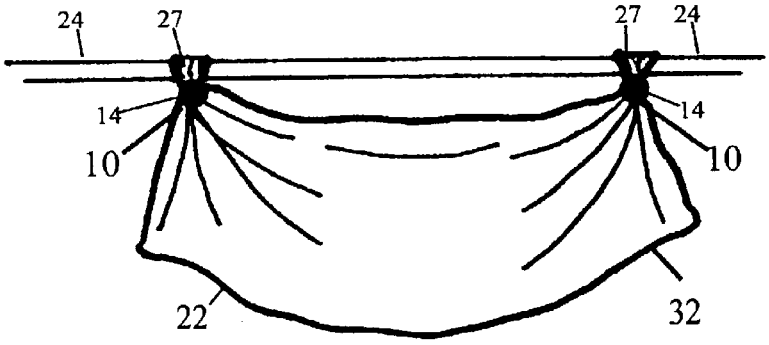

Securing device 10 is further capable of securing a flexible fabric panel 22 to a support bar 24 in another configuration as depicted in FIGS. 8 and 9. Initially, device 10 is secured about panel 22 as indicated in FIG. 6. Next, tail portion 27 of fabric panel 2 (i.e., the terminal end portion of the fabric panel that is not covered by the securing device) is wrapped or folded over support bar 24, as depicted in FIG. 8, such that the main portion of panel 22 lies in front of the support bar (i.e., the support bar is disposed between the main portion of the panel and a window supporting surface) and the tail portion lies in back of the support bar (i.e., the tail portion is disposed between the support bar and the window supporting surface). After the tail portion is folded over the support bar, securing section 14 is wrapped around both the main fabric panel section 22 and its tail section 27 to secure the fabric in place. The securing section is then inserted through any suitable portion of loop section 12, as depicted in FIG. 9, to firmly hold the fabric panel to the support bar in a desired configuration. The window treatment illustrated in FIG. 11 is one example in which the wrapping configuration of FIGS. 8 and 9 is utilized to form an arrangement 32.

Coupling of the two or more devices together, such as described above and illustrated in FIG. 5, renders the system capable for constructing alternative window treatment styles, such as those depicted in FIGS. 10, 14, 21, 27, 28 and 30. In each of these window treatment styles, the fabric panels are initially supported by a support bar 24 by feeding the support bar through a rod pocket 28 in each of the fabric panels 22, where the rod pocket is formed by stitches 29 at the top of each panel 22. In certain situations, the distance and location required to secure the panel to achieve the desired style is longer than a single device 10 can accommodate. Therefore, in such situations (e.g., as depicted in FIGS. 10, 14, 21, 27, 28 and 30), two devices 10 are coupled together to form a combined device 18 that is utilized to achieve the desired style. In addition, in situations where fabric panels have extended lengths or increased bulk, coupling of two or more devices 10 together may also be required to achieve any of the securing configurations described above and illustrated in FIGS. 6–9.

Combined device 18 secures a fabric panel in a selected configuration with respect to the support bar by wrapping device 18 about a selected portion of the fabric panel (and, optionally, the support bar) such that securing sections 14 are brought together. The securing section 14 of a first device 10 of the combined device 18 is then inserted through the loop section 12 of a second device 10 of the combined device 18 such that the securing sections of both the first and second devices engage each other. Further, the geometric configuration of each securing section 14 of the first and second devices 10 prevents or inhibits separation of their engagement without manual assistance, thus holding the fabric panel in the selected style or configuration with respect to the support bar. In an alternative combined device embodiment, where the securing section of a first securing device is disposed at one longitudinal end of the combined device and a loop section end of a second securing device is disposed at the other longitudinal end of the combined device, the securing section of the first securing device engages the loop section of the second securing device to secure the fabric panel in the selected style or configuration.

Figure 10:
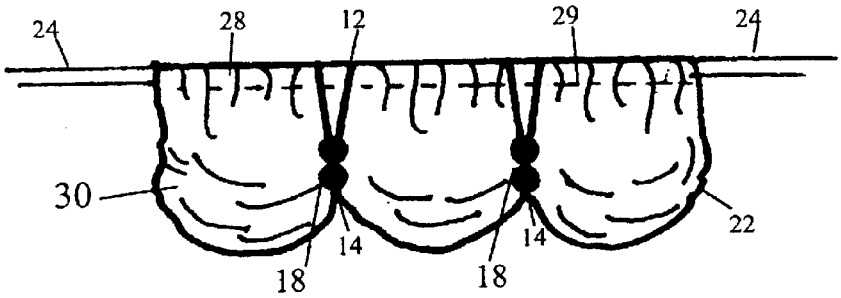
FIGS. 10–33 depict a variety of different hanging styles and configurations for securing fabric material to a support bar in accordance with the present invention utilizing the securing device of FIG. 5.

FIGS. 10–33 depict a variety of different window treatment styles that may be formed utilizing one or more devices 10, alone or coupled to form combined devices 18, to secure fabric panels in any one or more configurations as described above. In particular, FIG. 10 depicts a flexible fabric panel 22 arranged in a balloon style valance 30. The fabric is suspended from support bar 24 by passing the support bar through rod pocket 28 of the panel and using a pair of combined devices 18 to secure the fabric in place.

In FIG. 11, a single flexible fabric panel 22 is gathered at the corners and secured to a support bar 24 by attaching a securing device 10 to each panel corner. The fabric or material above the securing device, the tail 27, is folded over the support bar and secured to the main fabric panel by wrapping each securing device 10 around both sections of fabric and securing the securing section 14 of each device 10 under a section of the loop section. Thus, a window treatment configuration 32 is formed.

Figure 12:
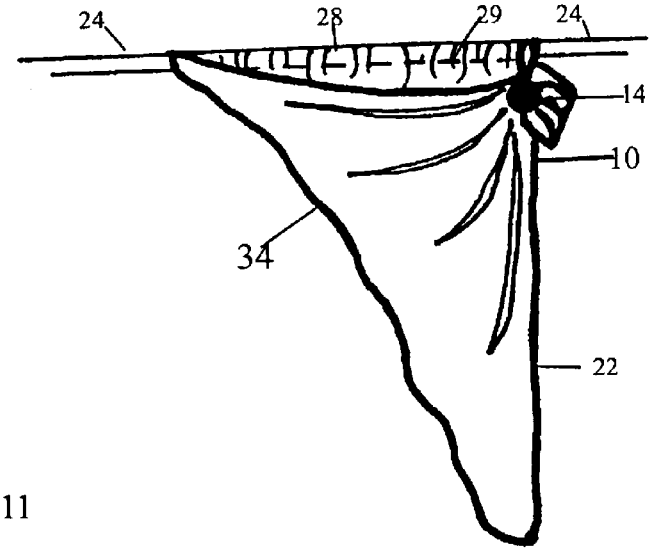

In FIG. 12, a single flexible fabric panel 22 is hung from a support bar 24 by passing the support bar through rod pocket 28 in a portion of the panel. A securing device 10 is attached to one bottom corner of the flexible fabric panel, drawn upwards and secured to the support bar to form a window treatment configuration 34.

In FIG. 13, two fabric panels 22 are hung from a support bar 24 by passing the support bar through rod pockets 28 disposed on the panels. A first panel is gathered and draped from the back to permit its tail portion 27 to hang over the front of the second fabric panel. The tail portion of first fabric panel is gathered together and secured with a securing device 10 to form a window treatment configuration 36.

Figure 14:
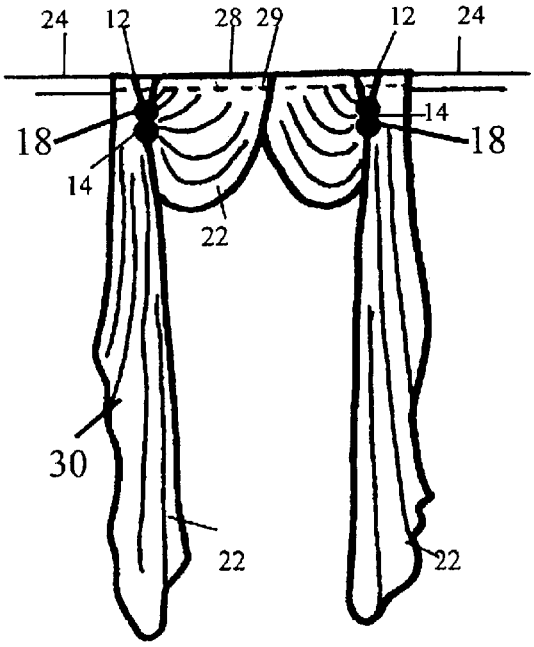

In FIG. 14, two flexible fabric panels 22 are hung from a support bar 24 by passing the support bar through rod pockets 28 disposed in the panels. The upper one third of each fabric panel 22 is gathered up towards a respective corner and secured in place by a combined device 18 by wrapping the combined device around the gathered fabric panel and the hanging support bar. Thus, a window treatment configuration 30 is formed.

In FIG. 15, a first flexible fabric panel 22 is hung from a support bar 24 by passing the support bar through a rod pocket 28 disposed in the panel. A second fabric panel 22 is secured, underneath the first fabric panel, to the support bar by attaching a securing device 10 (not visible in FIG. 15) to each of two opposing upper corners of the second fabric panel and then securing the securing devices to the support bar. Each of the first and second fabric panels is then gathered from center toward its outer side and secured in place with another securing device 10.

FIGS. 16–33 depict further exemplary embodiments of valance, mid-length and floor length window styles and arrangements (e.g., scallop, tail, asymmetric balloon, fan, swag, drape, etc.) that are possible using the one or more devices 10 and/or combined devices 18 of the present invention. However, one skilled in the art will readily recognize and appreciate that the invention is not limited to these embodiments. Rather, the system of the present invention may be utilized to achieve a wide variety of selected window treatment configurations.

Figure 31:
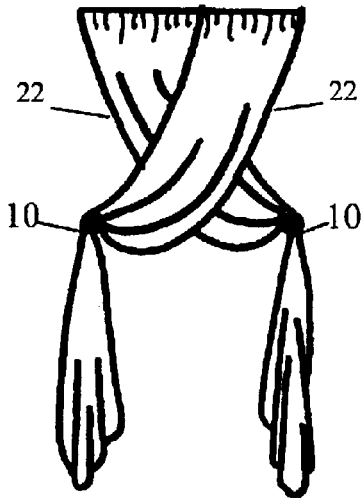
Figure 32:
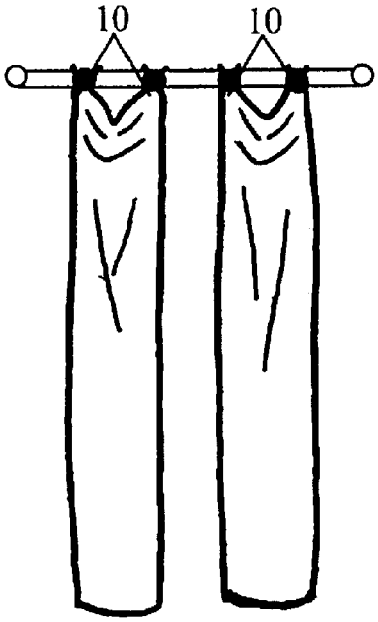
Figure 33:
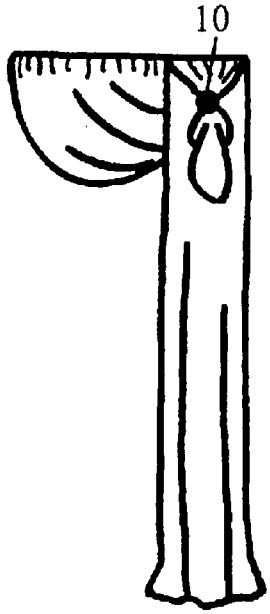

Referring to FIG. 31, a pair of fabric panels are suspended from support bar 24, and the fabric panels are directed such that one panel crosses over the other panel. A lower portion of each fabric panel is also secured by a respective securing device 10 to hold the lower portion in a suspended position. It is noted that, in this embodiment, the securing device for each fabric panel is wrapped about the fabric panel as well as an additional support structure extending from the window supporting surface to facilitate suspension of the lower portion of each fabric panel as depicted in FIG. 31.

The system of the present invention may further include a kit including one or more of the securing devices as described above, a fabric support structure (e.g., a support bar as described above and illustrated in the figures) as well as suitable mounting hardware (e.g., brackets, screws, etc.) for mounting the support structure to a selected support surface, and one or more fabric panels, optionally having rod pockets or other suitable structure (e.g., loops disposed along an upper surface of the fabric panels) for engaging with the fabric support structure. The kit may also include one or more instruction manuals to provide appropriate instructions for assembly of the support structure to the support surface, and securing the one or more fabric panels in selected window treatment configurations utilizing one or more securing devices (e.g., utilizing the methods described above and illustrated in FIGS. 5–9).

Having described a novel multifunctional window covering system and corresponding methods for securing fabric material with respect to a window structure, it is believed that other modifications, variations and changes will be suggested to those skilled in the art in view of the teachings set forth herein. It is therefore to be understood that all such variations, modifications and changes are believed to fall within the scope of the present invention as defined by the appended claims.

What is claimed is:

1. A window covering system for securing a fabric material with respect to a window structure in a selected configuration, the system comprising at least one securing device including:

an elongated elastic loop section;

a securing section connected to the loop section at a longitudinal end of the at least one securing device, the at least one securing device being configured to wrap around the fabric material such that the securing section extends through and engages the loop section to maintain the fabric material in the selected configuration; and an instructional material providing instructions for how to utilize the at least one securing device, wherein the instructional material includes at least the instructional steps of wrapping the at least one securing device around the fabric material, inserting the securing section through the loop section, and, after insertion of the securing section through the loop section, engaging the securing and loop sections to maintain the fabric material in the selected configuration with respect to the window structure.

2. The system of claim 1, wherein the securing section includes one of a knob fastener and a hook fastener.

3. The system of claim 1, wherein the at least one securing device includes first and second securing devices coupled together to form a combined securing device.

4. The system of claim 3, wherein the combined securing device is formed by inserting the second securing device through the loop section of the first securing device so that a portion of the loop section of the second securing device is disposed between the loop section of the first securing device, and then inserting the securing section of the second securing device through the loop section of the second securing section.

5. The system of claim 4, wherein the securing sections of the first and second securing devices are disposed at opposing ends of the combined securing device.

6. The system of claim 1, further comprising at least one of:

a fabric panel forming at least a portion of the fabric material to be secured in the selected configuration utilizing the at least one securing device; and a support structure to support the fabric material with respect to the window structure.

7. A method of securing a fabric material with respect to a window structure in a selected configuration utilizing at least one securing device, the at least one securing device including an elongated elastic loop section and a securing section connected to the loop section at a longitudinal end of the at least one securing device, the method comprising:

(a) wrapping the at least one securing device around the fabric material; and (b) inserting the securing section through the loop section; and (c) after insertion of the securing section through the loop section, engaging the securing and loop sections to maintain the fabric material in the selected configuration with respect to the window structure.

8. The method of claim 7, wherein the securing section of the at least one securing device includes one of a knob fastener and a hook fastener, and the loop section is engaged with the securing section by fastening a portion of the loop section to the fastener.

9. The method of claim 7, wherein the at least one securing device includes a first securing device and a second securing device, the method further comprising:

(d) inserting the second securing device through the loop section of the first securing device so that a portion of the loop section of the second securing device is disposed between the loop section of the first securing device; and (e) after insertion of the second securing device through the loop section of the first securing device, inserting the securing section of the second securing device through the loop section of the second securing section to form a combined securing device.

10. The method of claim 9, wherein the securing sections of the first and second securing devices are disposed at opposing ends of the combined securing device, and (a) includes:

(a1) wrapping the combined securing device around the fabric material;

(b) includes:

(b1) inserting the securing section of the first securing device through the loop section of the second securing device; and (c) includes:

(c1) engaging the securing sections of the first and second securing devices to maintain the fabric material in the selected configuration with respect to the window structure.

11. The method of claim 7, further comprising:

wrapping the at least one securing device around a support structure disposed proximate the window structure prior to inserting the securing section through the loop section;

wherein the fabric material is supported by and suspended from the support structure.

* * * * *